US005590982A

United States Patent [19]

Huete

[11] Patent Number: 5,590,982

[45] Date of Patent: Jan. 7, 1997

[54] TENDON CLUSTER ARRAY

[75] Inventor: David A. Huete, Spring, Tex.

[73] Assignee: Shell Oil Company, Houston, Tex.

[21] Appl. No.: 370,762

[22] Filed: Dec. 23, 1994

[51] Int. Cl.[6] ..... E02D 5/74; E02D 23/00

[52] U.S. Cl. ..... 405/223.1; 405/224; 405/195.1

[58] Field of Search ..... 405/223.1, 224, 405/195.1; 114/264, 265, 294

[56] References Cited

U.S. PATENT DOCUMENTS

| | | | |
|---|---|---|---|
| 3,540,396 | 11/1970 | Horton | 405/223.1 X |
| 3,577,946 | 5/1971 | Horton | 114/0.5 |
| 3,934,528 | 1/1976 | Horton et al. | 114/0.5 D |
| 3,982,492 | 9/1976 | Steddum | 114/0.5 D |
| 3,996,755 | 12/1976 | Kalinowski | 114/265 X |
| 4,114,393 | 9/1978 | Engle, Jr. et al. | 114/264 |
| 4,198,179 | 4/1980 | Pease et al. | 405/195 |
| 4,320,993 | 3/1982 | Hunter | 405/224 |
| 4,421,436 | 12/1983 | Burns | 405/60 |
| 4,423,985 | 1/1984 | Aagaard | 405/224 |
| 4,437,794 | 3/1984 | Grimsley et al. | 405/224 |
| 4,895,481 | 1/1990 | Pepin-Lehalleur et al. | 405/223.1 |
| 5,190,411 | 3/1993 | Huete et al. | 40/223 |
| 5,195,848 | 3/1993 | Huete et al. | 405/202 |
| 5,199,821 | 4/1993 | Huete et al. | 405/202 |
| 5,342,148 | 8/1994 | Huete et al. | 405/223.1 |
| 5,421,676 | 6/1995 | Wybro et al. | 405/223.1 |
| 5,423,632 | 6/1995 | Ekvall et al. | 405/223 |
| 5,439,324 | 8/1995 | Ekvall et al. | 405/202 |

*Primary Examiner*—Stephen J. Novosad
*Assistant Examiner*—Tara L. Mayo
*Attorney, Agent, or Firm*—Mark A. Smith

[57] ABSTRACT

A tendon cluster array is disclosed for tethering a superstructure of a tension leg platform to an ocean floor in which a plurality of tendons are anchored to the ocean floor at their lower ends with a substantially planar, horizontally disposed tendon bracket receiving the upper ends. A tendon bracket connection pivotally secures the tendon bracket to a downwardly disposed surface of the superstructure.

14 Claims, 5 Drawing Sheets

FIG. 1
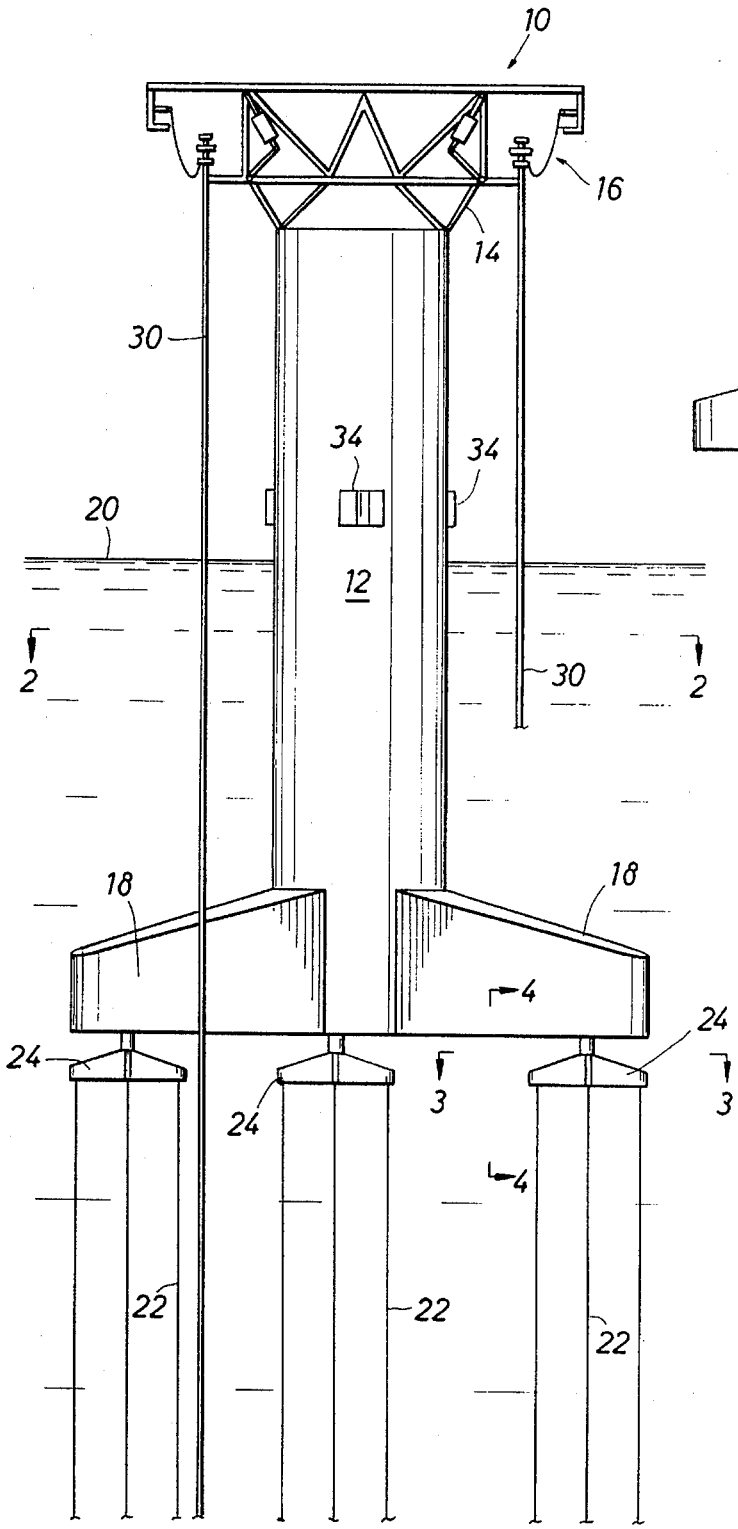
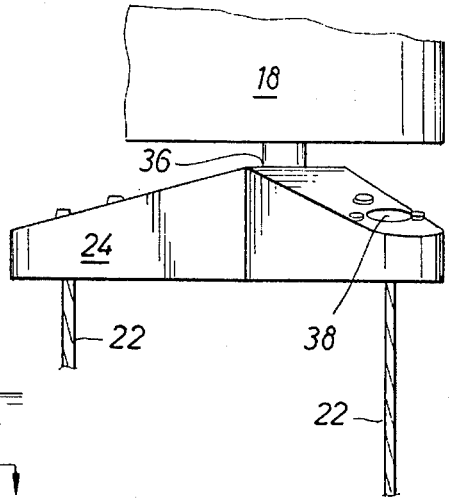
FIG. 4

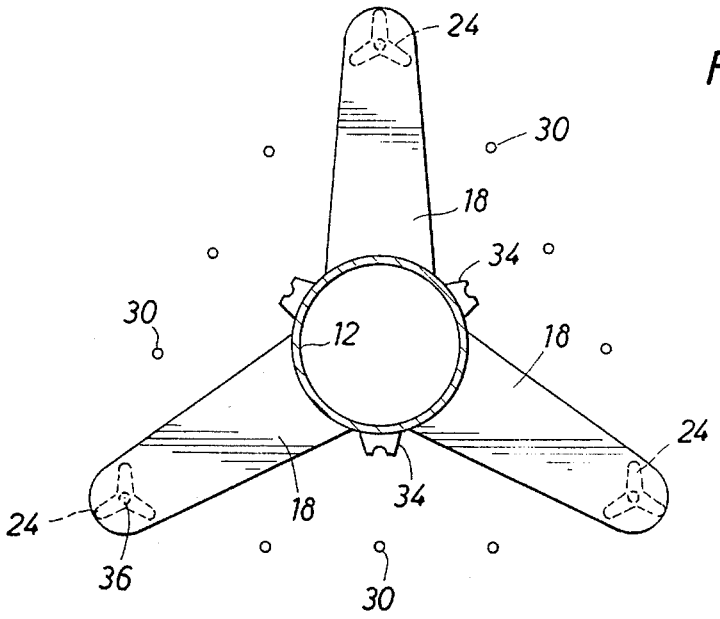
FIG. 2
FIG. 3
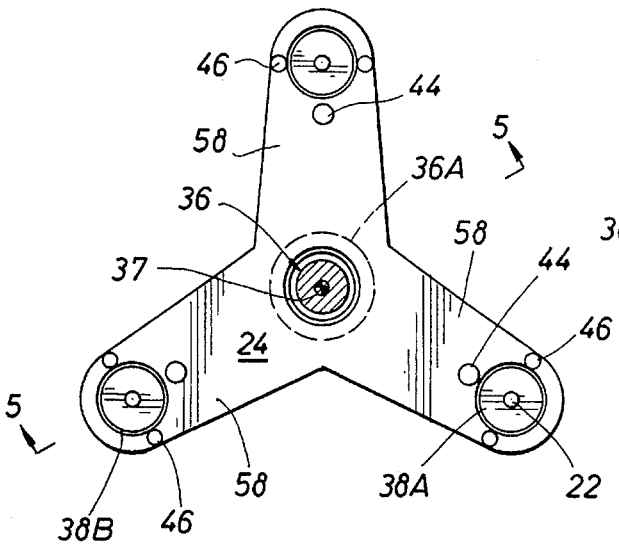
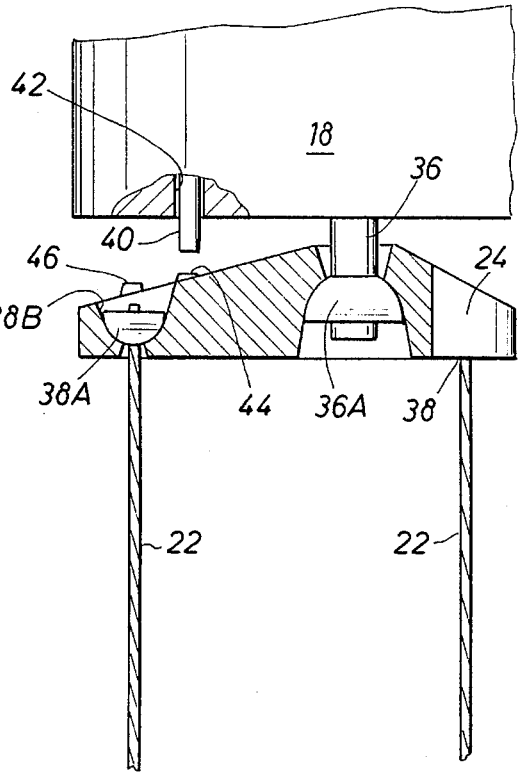
FIG. 5

TENDON CLUSTER ARRAY

BACKGROUND OF THE INVENTION

The present invention relates to deepwater offshore platforms. More particularly, it relates to tension leg platforms having a plurality tendons. Sometimes such tendons are referred to as tethers which term is understood to mean the same thing.

Small, minimum-capability platforms have several advantages over large, full-capability platforms in the development of hydrocarbon reserves in deep water. A much lower capital cost is one of the significant advantages. However, minimizing platform capability by eliminating a resident drilling rig and other useful equipment from the design also significantly limits the ability of the platform to adapt to new reservoir and/or economic information suggesting changes in the development scenario. The Tension Leg Well Jacket (TLWJ) concept was developed to address this limitation. In the TLWJ concept, a small Tension Leg Platform or "TLP" (the TLWJ, mini-spar or other minimal structure) supports the wells for surface accessible completions, but drilling and other major well operations are performed by a semisubmersible drilling rig which docks to or is otherwise restrained adjacent the TLWJ. This method of conducting well operations is more fully discussed in U.S. Pat. No. 5,199,821, issued Apr. 6, 1993 to D. A. Huete et al for a Method for Conducting Offshore Well Operations and U.S. patent application Ser. No. 024,584, now U.S. Pat. No. 5,439,324, filed by A. G. C. Ekvall et al on Mar. 1, 1993, for Bumper Docking Between Offshore Drilling Vessels and Compliant Platforms, the disclosures of which are hereby incorporated by reference and made a part hereof.

It is understood that the smaller the floating platform, i.e., the smaller the total hull displacement, the cheaper it is. Another benefit of the decreasing the size of the structure is that lower loads on the tendons expand the scope of suitable materials for forming the tendons. Thus, full capability platforms have used thick walled tubular goods to form the tendons. These are expensive to produce and relatively difficult to deploy.

By contrast, wire rope tendons would be desirable in this lighter service for their economy and ease of installation. However, there is another contrast between tubular goods and wire rope in tendon applications. Tubular goods have greater reliability, in large part because of inspectability in manufacture and in service. The cylindrical walls of such tubular goods may be inspected inside and out. In contrast, it is more difficult to determine whether a wire rope has suffered damage because the majority of the load-carrying portion is hidden from view.

SUMMARY OF THE INVENTION

An advantage of the present invention is that it effectively distributes loads across a plurality of tendons in a manner providing for cost efficient redundancy.

Another advantage of the present invention is that it provides for failure detection for tendons in materials and fabrication techniques that makes continued in-service monitoring otherwise unreliable.

The forgoing advantages facilitate the use of wire rope or other unconventional, non-tubular tendons permitting the use of less expensive materials and fabrication techniques with greater confidence.

Toward the fulfillment of these and other advantages, the present invention provides a tendon cluster for tethering a superstructure of a tension leg platform to an ocean floor in which a plurality of tendons are anchored to the ocean floor at their lower ends with a substantially planar, horizontally disposed tendon bracket receiving the upper ends. A tendon bracket connection pivotally secures the tendon bracket to a downwardly disposed surface of the superstructure.

A BRIEF DESCRIPTION OF THE DRAWINGS

The brief description above, as well as further features and advantages of the present invention will be more fully appreciated by reference to following detailed description of illustrative embodiments which should be read in conjunction with the accompanying drawings in which:

FIG. 1 is a side perspective view of a tension leg caisson deploying one embodiment of a tendon cluster array in accordance with the present invention;

FIG. 2 is a cross-sectional view of the tension leg caisson of FIG. 1 taken along line 2—2 in FIG. 1;

FIG. 3 is a partially cross-sectional top elevational view of a tribrach and the tendon cluster array deployed in FIG. 1, taken along line 3—3 in FIG. 1;

FIG. 4 is side elevational view of the tribrach and tendon cluster of FIG. 3, taken along line 4—4 in FIG. 1;

FIG. 5 is a partially cross-sectioned side view of the tribrach and tendon cluster of FIG. 4;

DETAILED DESCRIPTION OF SELECTED EMBODIMENTS

Figure 6:
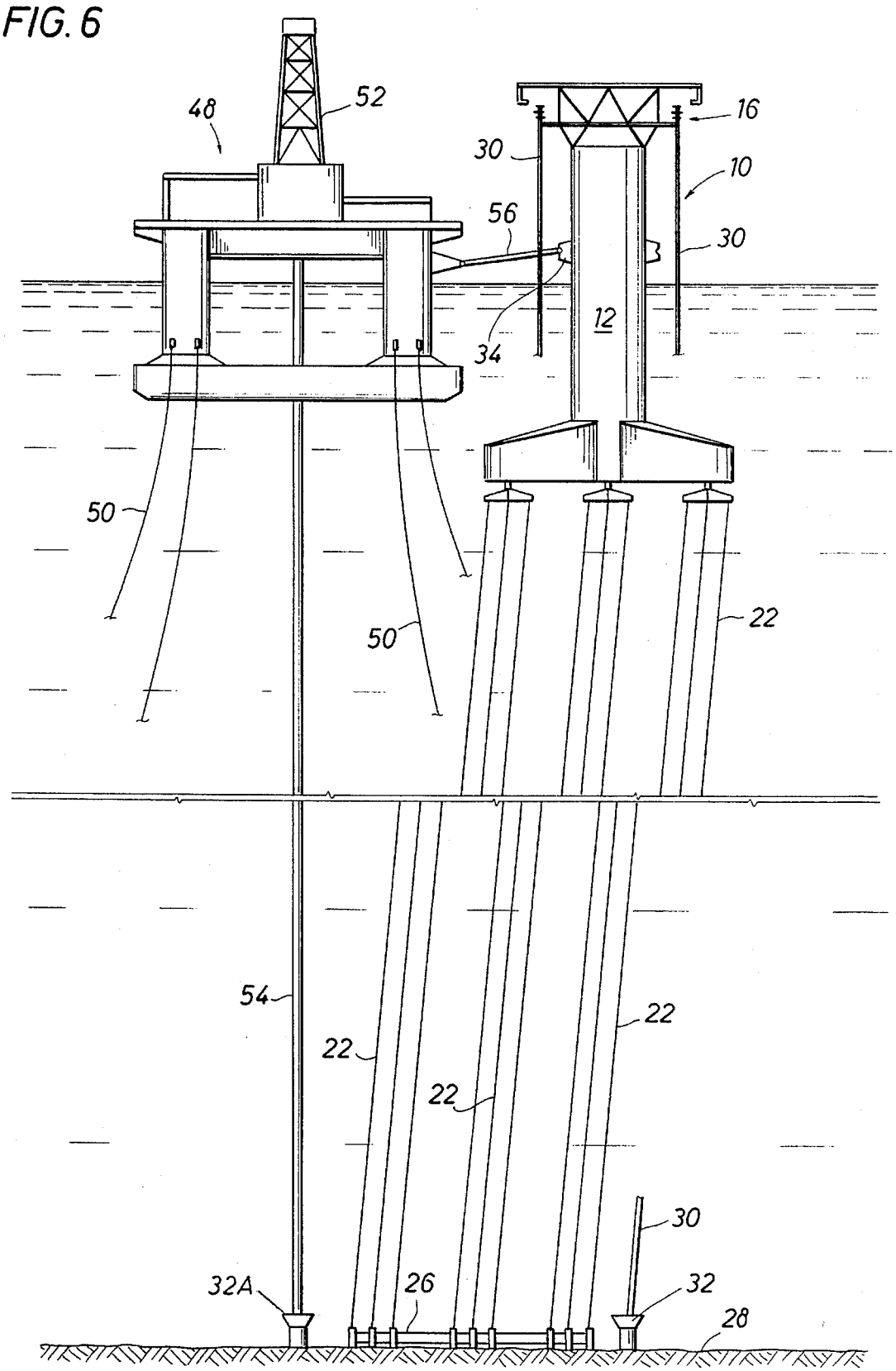
FIG. 6 is a side elevational view of a tension leg caisson accepting drilling operations from a semisubmersible drilling rig.

FIG. 1 illustrates one embodiment of a tendon cluster array in accordance with the present invention, here deployed with the superstructure of a tension leg platform in the form of tension leg caisson 10 in body of water 20. The tension leg caisson has an elongated buoyant central caisson or vertical column 12 supporting a deck 14 with surface facilities 16. A plurality of three or more outrigger pontoons 18 project radially from the base of central caisson 12 in a horizontal plane. The stability of tension leg caisson 10 may be enhanced by taking on ballast in pontoons 18.

A plurality of tethers or tendons 22 are arranged in tendon cluster arrays to anchor the tension leg caisson to the ocean floor (not shown) and draw it down below its free floating draft to limit heave response. Cluster arrays of tendons 22 are connected to the outrigger pontoons at substantially equal distances from central caisson 12. In this embodiment, tendons 22 are clustered at tribrachs 24, each connected to one of outrigger pontoons 18. The bottoms of tendons 22 are connected to foundation 26 which is secured to ocean floor 28 by conventional means such as piles. See FIG. 6.

Returning to FIG. 1, a plurality of production risers 30 connect surface facilities 16 with wells 32 on ocean floor 28 for production operations. Drilling operations may be conveniently provided on a temporary basis by a semisubmersible rig. Refer again to FIG. 6. Provisions are made to receive the drilling facilities with a plurality of semisubmersible rig docking strut receptacles 34.

FIG. 2 illustrates the arrangement in this embodiment of pontoons 18, tendons 22, tendon clusters at tribrachs 24, production risers 30, and strut docking receptacles 34 about central caisson 12. Spreading the tribachs apart on the outrigger pontoons serves to limit roll and pitch of the tension leg caisson. Ballasting the pontoons further limits this response.

FIGS. 3, 4 and 5 illustrate tribrach 24 and clusters of tendons 22. FIG. 4 is a close up of the substantially planar, horizontally disposed tendon bracket or tribrach 24. Tribrach 24 depends from the platform superstructure at outrigger pontoon 18 through a tendon bracket connection 36. The partially broken away view of FIG. 5 illustrates tendon bracket connection 36 in greater detail. Here, the tendon bracket connection is a hemispherical flexjoint 36A which is a steel and elastomeric laminated joint, but other connection allowing pivotal action could be used. FIG. 5 also illustrates an upper tendon connection 38 in which a termination fixture 38A is secured to tendon 22. In the illustrated embodiment, termination fixture 38A is also a hemispherical flexjoint seated in a tendon receiving receptacle 38B. See also the top view of FIG. 3.

FIG. 5 also introduces the use of installation and leveling jack 40 disposed to project from pontoon 18 through access hole 42. A jack foot 44 is presented on tribrach 24 where the jack will engage. Failure stops 44 are also illustrated in FIGS. 3 and 5. The use of these features will be discussed in greater detail in connection with FIGS. 7A–7D.

FIG. 3 illustrates an overall arrangement of failure stops 46 and jack feet 44 on lobes 58 of tendon bracket 24. Tendons are arranged radially and circumferentially equidistant equidistant about normal load centroid 37. Both the failure stops and the jack feet are arranged in substantially radial alignment with load lines between the normal load centroid of the tendon bracket and the upper tendon connections.

FIG. 6 illustrates the use of the method of conducting offshore well operations disclosed U.S. Pat. No. 5,199,821, referenced above. Semisubmersible drilling vessel 48 docks through strut 56 to tension leg caisson 10 at strut receptacle 34 on vertical column 12. Mooring lines 50 from vessel 56 are then adjusted to bring derrick 52 in line for conducing drilling operations for well 32A through a substantially vertical drilling riser 54. In this embodiment, achieving this alignment will temporarily bias tension leg caisson 10 out of its normal position centered over foundation 26. After a well is drilled, a production riser 30 is run to the well and attached to surface facilities 16 on the platform. Additional wells are drilled by repeating the process.

Figure 7A:
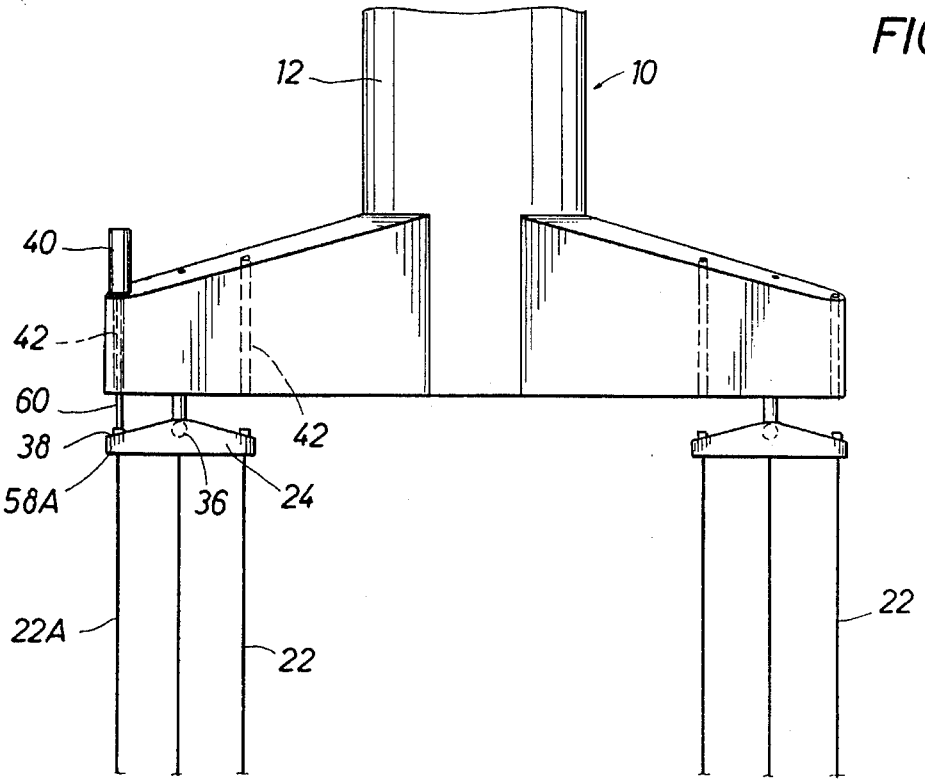
FIGS. 7A–7D illustrate tendon installation, normal deployment, failure mode and leveling compensation, respectively, in the use of tribrach and tendon clusters in a tension leg caisson.

FIGS. 7A–7D schematically illustrate the use of tendon bracket or tribrach 24 in clusters arrays of tendons 22, preferable in groups of three tendons each. FIG. 7A illustrates use of jack 40 in the installation of a tendon. Jack 40 is connected to outrigger pontoon 18 and disposed to project its rod 60 through access hole 42 and against a lobe 58A of tribrach 24 at which a given tendon 22A is to be installed. Hydraulically extending rod 60 will, in a three tendon cluster, drive lobe 58A downward. This will provide greater access to upper tendon connection 38 and provide some slack facilitating secure and tight installation of termination fixture 38A within a recess 38B and about tendon 22A. See also FIG. 5.

Figure 7B:
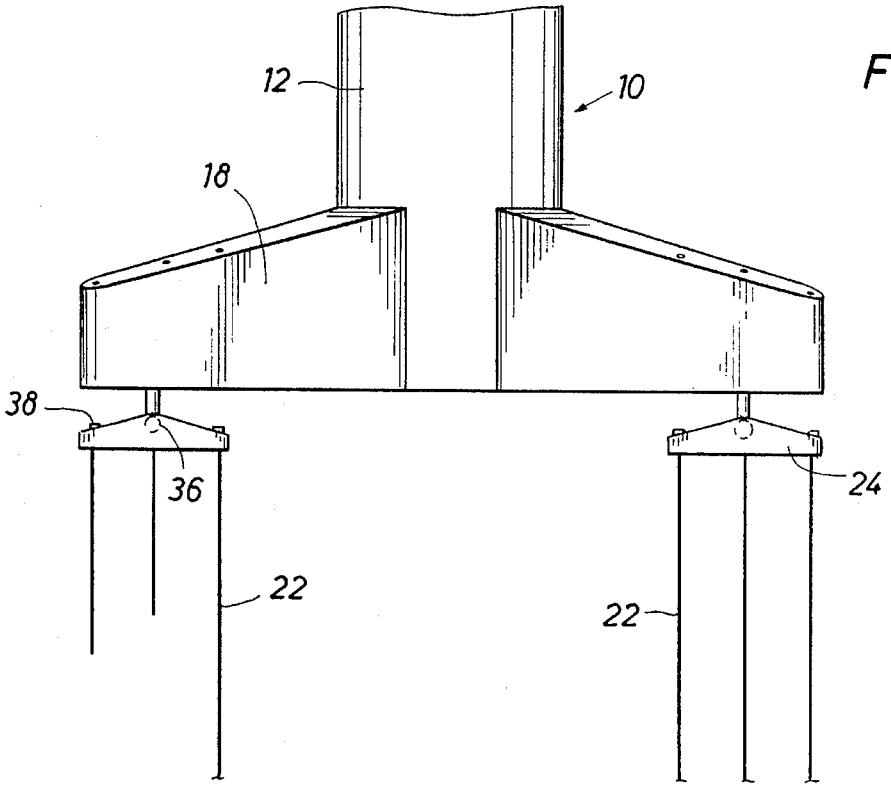
Figure 7C:
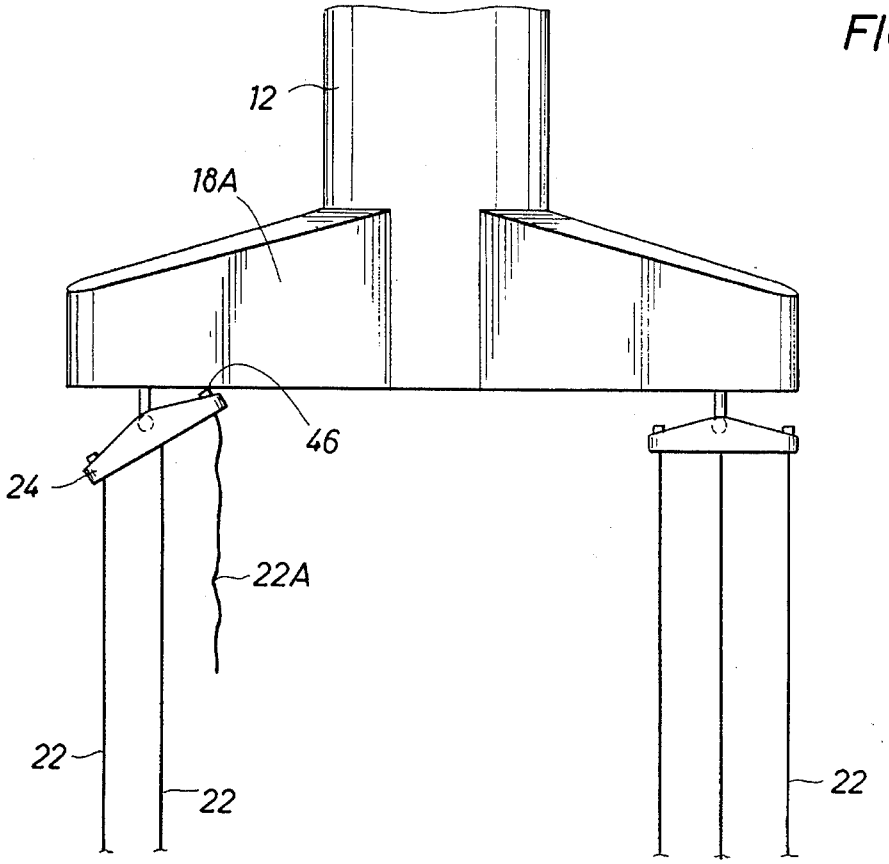
Figure 7D:
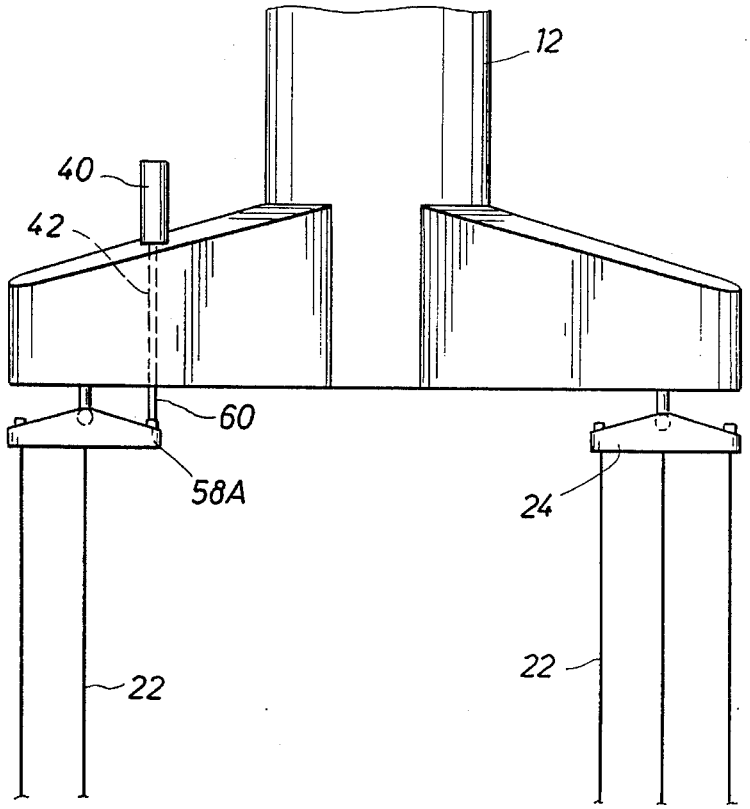

FIG. 7B illustrates the use of tendon clusters and tendon brackets at normal trim, with each of tendons 22 sharing the load in its tendon cluster. By contrast, FIG. 7C illustrates failure mode in which one of tendons 22, here tendon 22A has parted. This causes tribrach 24 to pivot about tendon bracket connection 36, brings failure stop 46 into contact with the bottom of outrigger pontoon 18A and redistributes the load among the remaining tendons.

Pivoted, the tendon bracket contributes to the effective length of the remaining tendon and may cause the platform to perceptibly tilt as pontoon 18A rises. This provides notice that one of the tendons has failed and provides an opportunity to attend to repairs promptly. Alternatively, instrumentation could indicate contact of the tendon bracket and the failure stop. Jack 40 is also useful in leveling the platform by pushing down lobe 58A until a new tendon is available and ready for installation procedures. See FIG. 7D.

It should be appreciated that the tendon bracket/tendon cluster combination facilitates the use of wire rope or other unconventional, non-tubular tendon applications in which less expensive materials and fabrication techniques can be used in greater confidence by effectively distributing the load and having positive confirmation in the event of a partial (one tendon of cluster) failure within a redundant system.

The configuration described herein is statically determinate, in that loads in the tendons will be apportioned according to where they are connected to the caisson, and are independent of the elasticity of the tendons themselves. While remaining substantially horizontal, the tribrach will pivot to distribute this load evenly. This feature provides the benefit of simplifying tendon installation compared to conventional TLPs, as complex ballasting and tendon tensioning operations are not required.

A number of variations have been disclosed for employing the present invention. However, other modifications, changes and substitutions are intended in the foregoing disclosure. Further, in some instances, some features of the present invention will be used without a corresponding use of other features described in these illustrative embodiments. Accordingly, it is appropriate that the appended claims be construed broadly and in a manner consistent with the spirit and scope of the invention herein.

What is claimed is:

1. A tendon cluster for tethering a superstructure of a tension leg platform to an ocean floor, comprising:

a plurality of non-tubular tendons for anchoring to the ocean floor at their lower ends;

a substantially planar, substantially horizontally disposed tendon bracket receiving the upper ends of the tendons in tendon terminations;

a tendon bracket connection pivotally securing the tendon bracket to a downwardly disposed surface of the superstructure through a semispherical flexjoint at a normal load centroid of the tendon bracket; and a jack mount disposed between the superstructure and the tendon bracket and arranged in radial alignment of the upper tendon connection and the normal load centroid.

2. A tendon cluster for tethering a superstructure of a tension leg platform to an ocean floor, comprising:

a plurality of three or more tendons adapted to be anchored to the ocean floor at their lower ends;

a substantially planar, horizontally disposed tendon bracket receiving the upper ends of the tendons; and a tendon bracket connection pivotally securing the tendon bracket to a downwardly disposed surface of the superstructure.

3. A tendon cluster in accordance with claim 2 wherein the tendons are formed of wire ropes.

4. A tendon cluster in accordance with claim 3 wherein the plurality of tendons is a group of three tendons which are arranged in a tendon cluster.

5. A tendon cluster in accordance with claim 2 wherein the tendon bracket connection is formed by a hemispherical flexjoint forming a pivotable joint at a normal load centroid substantially in the plane of the tendon bracket, said plane being substantially orthogonal to the tendons.

6. A tendon cluster in accordance with claim 5 further comprising a plurality of failure stops projecting part way between the superstructure and the tendon bracket arranged substantially in radial alignment of the upper tendon connection and the normal load centroid.

7. A tendon cluster in accordance with claim 6, further comprising at least one jack disposable between the superstructure and the tendon bracket and arranged in radial alignment of the upper tendon connection and the normal load centroid.

8. A tendon cluster in accordance with claim 6, further comprising at least one jack disposable between the superstructure and the tendon bracket and arranged in radial alignment of the upper tendon connection and the normal load centroid.

9. A tendon bracket for receiving a plurality of tendons in a tendon cluster in service to secure a tethered structure, comprising:

a tendon bracket base having a normal load centroid and a plurality of radially disposed lobes substantially within the same plane;

a plurality of tendon receiving receptacles arranged in a horizontal plane, each presented on one of the lobes; and a hemispherical flexjoint tendon bracket connection suitable for pivotally securing the tendon bracket to a downwardly disposed surface of the tethered structure.

10. A tendon bracket in accordance with claim 9 further comprising a plurality of failure stops projecting from the tendon bracket base substantially orthogonally to the plane defined by the tendon receiving receptacles.

11. A tendon bracket in accordance with claim 10 further comprising a plurality of jack feet, one on each of the lobes of the tendon bracket base.

12. A tendon bracket in accordance with claim 10 further comprising a plurality of jack feet, one on each of the lobes of the tendon bracket base.

13. A tendon bracket for receiving a plurality of tendons in a tendon cluster in service to secure a tethered structure, comprising:

a tendon bracket base having a normal load centroid and a plurality of radially disposed lobes;

a plurality of tendon receiving receptacles arranged in a horizontal plane, each presented on one of the lobes;

a tendon bracket connection suitable for pivotally securing the tendon bracket to a downwardly disposed surface of the tethered structure; and a plurality of failure stops projecting from the tendon bracket base substantially orthogonally to the plane defined by the tendon receiving receptacles.

14. A tendon cluster for tethering a superstructure of a tension leg platform to an ocean floor, comprising:

a plurality of three wire rope tendons anchored to the ocean floor at their lower ends;

a substantially planar, horizontally disposed tendon bracket receiving the upper ends of the tendons;

a tendon bracket connection pivotally securing the tendon bracket to a downwardly disposed surface of the superstructure, said tendon bracket connection being formed by a hemispherical flexjoint forming a pivotable joint at a normal load centroid of the tendon bracket; and a plurality of failure stops projecting part way between the superstructure and the tendon bracket arranged substantially in radial alignment of the upper tendon connection and the normal load centroid.

* * * * *